US007862650B2

(12) United States Patent
Dooley

(10) Patent No.: US 7,862,650 B2
(45) Date of Patent: Jan. 4, 2011

(54) WOVEN ELECTROSTATIC OIL PRECIPITATOR ELEMENT

(75) Inventor: Kevin Allan Dooley, Mississauga (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 0 days.

(21) Appl. No.: 12/686,683

(22) Filed: Jan. 13, 2010

(65) Prior Publication Data

US 2010/0107882 A1 May 6, 2010

Related U.S. Application Data

(62) Division of application No. 11/669,240, filed on Jan. 31, 2007, now abandoned.

(51) Int. Cl.
*B03C 3/41* (2006.01)

(52) U.S. Cl. ..... 96/96; 96/67

(58) Field of Classification Search ..... 96/66, 96/67, 69, 88, 95, 96
See application file for complete search history.

(56) References Cited

U.S. PATENT DOCUMENTS

| | | | | |
|---|---|---|---|---|
| 0,342,548 | A | 5/1886 | Walker | |
| 895,729 | A * | 8/1908 | Cottrell | 95/73 |
| 1,067,974 | A | 7/1913 | Cottrell | |
| 1,428,839 | A | 9/1922 | Fortesque | |
| 2,000,654 | A | 5/1935 | Wintermute | |
| 3,070,977 | A | 1/1963 | Kimmel et al. | |
| 3,271,932 | A | 9/1966 | Newell | |
| 3,392,509 | A | 7/1968 | Pelosi, Jr. | |
| 3,406,669 | A | 10/1968 | Edwards | |
| 5,024,685 | A | 6/1991 | Torok et al. | |
| 5,405,434 | A | 4/1995 | Inculet | |
| 5,429,669 | A | 7/1995 | Chang | |
| 5,474,599 | A | 12/1995 | Cheney et al. | |
| 5,573,577 | A * | 11/1996 | Joannou | 96/66 |
| 5,855,653 | A | 1/1999 | Yamamoto | |
| 5,911,213 | A | 6/1999 | Ahlborn et al. | |
| 6,090,189 | A | 7/2000 | Wikstrom et al. | |
| 6,162,285 | A | 12/2000 | Fong et al. | |
| 6,176,902 | B1 | 1/2001 | Matsubara | |
| 6,221,136 | B1 | 4/2001 | Liu et al. | |
| 6,224,653 | B1 | 5/2001 | Shvedchikov et al. | |
| 6,231,643 | B1 | 5/2001 | Pasic et al. | |
| 6,375,714 | B1 * | 4/2002 | Rump et al. | 95/3 |
| 6,497,754 | B2 * | 12/2002 | Joannou | 96/67 |
| 6,878,192 | B2 | 4/2005 | Pasic | |
| 7,377,962 | B2 * | 5/2008 | Tanaka et al. | 96/83 |
| 7,438,747 | B2 | 10/2008 | Luo | |
| 7,452,410 | B2 | 11/2008 | Bergeron et al. | |
| 7,465,338 | B2 | 12/2008 | Kurasek | |
| 2001/0020417 | A1 | 9/2001 | Liu et al. | |
| 2006/0214111 | A1 | 9/2006 | Luo | |
| 2008/0178737 | A1 * | 7/2008 | Dooley | 95/81 |

FOREIGN PATENT DOCUMENTS

| | | |
|---|---|---|
| EP | 00157089 | 10/1985 |
| GB | 2016305 | 9/1979 |

* cited by examiner

*Primary Examiner*—Richard L Chiesa
(74) *Attorney, Agent, or Firm*—Ogilvy Renault LLP

(57) ABSTRACT

An electrostatic precipitator element includes preferably a mesh made of at least two individually insulated conductors with defined openings therebetween. An electrical field in the openings electrostatically attracts suspended particulate to a respective conductor for collection.

8 Claims, 3 Drawing Sheets

WOVEN ELECTROSTATIC OIL PRECIPITATOR ELEMENT

CROSS-REFERENCE TO RELATED APPLICATIONS

This is a Division of Applicant's U.S. patent application Ser. No. 11/669,240 filed on Jan. 31, 2007 , now abandoned .

TECHNICAL FIELD

The present concept relates generally to an electrostatic precipitator for separating particles or droplets from aerosol flows, and more particularly, to an improved method and apparatus for separating oil from an oil/gas mixture.

BACKGROUND OF THE ART

Electrostatic precipitation is known for removing suspended particulate matters from a gas (aerosol) flow for gas cleaning, air pollution control, oil/air separation, etc. The fundamental design of electrostatic precipitators has remained relatively unchanged since early applications of electrostatic precipitation in the nineteenth century. In its simplest form for a single stage precipitator, a high DC voltage is applied to a central electrode positioned in a grounded casing in order to cause a corona discharge to develop between the central electrode and the conductive interior surface of the casing. As the gas containing suspended particles flows between the electrode and the conductive interior surface of the casing, the particles are electrically charged by the corona ions. The charged particles are then precipitated electrostatically by the electric field onto the conductive interior surface of the casing where the charged particles neutralize. This normally involves very high voltages to achieve high electric field strengths, which causes a safety issue of arcing. This may be problematic for some applications where the fluids or gas/particle mixture may be ignited by a spark, such as in a fuel system or oil system of a gas turbine engine.

Accordingly, there is a need to provide an improved electrostatic precipitator.

SUMMARY

In accordance with one aspect of the present concept, there is an electrostatic precipitator element which comprises a mesh made first, second and third insulated conductors, the first and second insulated conductors arranged relative to one another to define openings of the mesh, the third insulated conductor extending through the individual openings of the mesh, the first, second and third conductors being configured to be connected to a voltage source to thereby in use create an electric field among the first, second and third conductors; and an apparatus configured for directing an aerosol flow through the openings of the mesh, wherein, in use, particulate matters suspended in the aerosol flow are electrostatically attracted to at least one of the first. second and third conductors when said electric field is present.

In accordance with another aspect of the present concept an electrostatic precipitator comprises a container including an inlet for introducing a flow of an oil/air mixture thereinto, and a first outlet for discharging an air flow and a second outlet for discharging liquid oil; and a mesh supported within the container and located between the inlet and the first outlet, the mesh being formed with at least three conductors to define openings of the mesh to permit the oil/air mixture to flow therethrough, the three conductors being individually insulated and adapted to receive an electric voltage applied thereover to create an electric field in each of the openings, thereby attracting oil particles in the oil/air mixture to an insulated surface of at least one of the three conductors to form oil droplets to be discharged through the second outlet.

Further details of these and other aspects of the present concept will be apparent from the detailed description and drawings included below.

DESCRIPTION OF THE DRAWINGS

Reference is now made to the accompanying FIGS. depicting aspects of the present concept, in which.

DETAILED DESCRIPTION OF THE PREFERRED EMBODIMENTS

Figure 1:
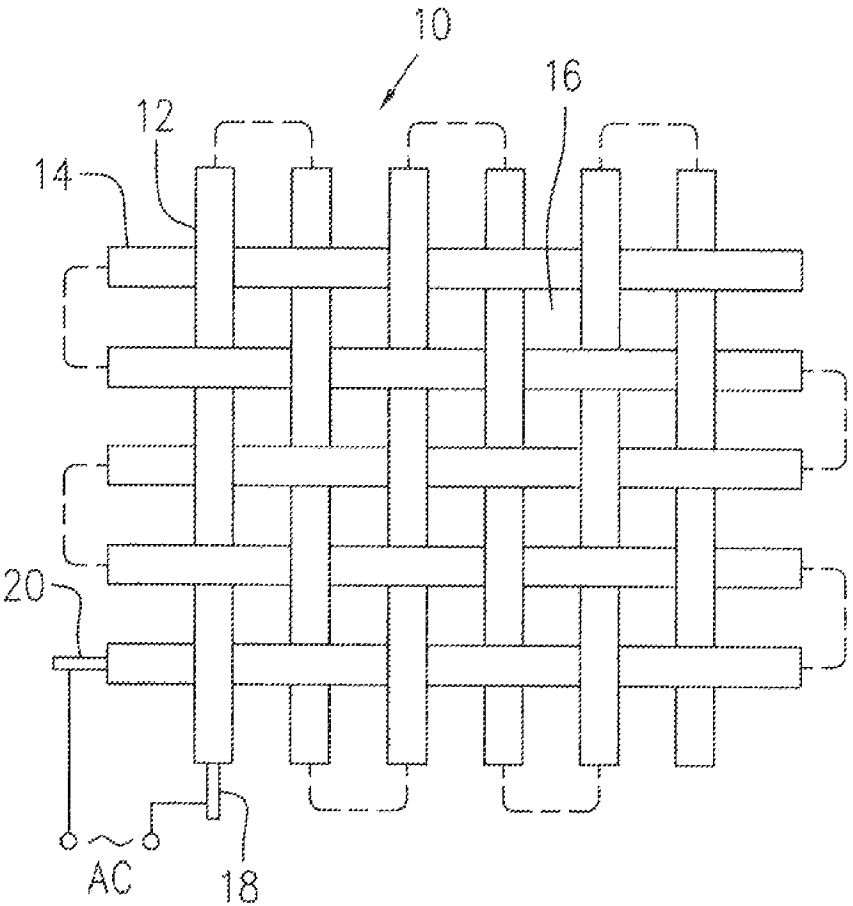
FIG. 1 is a schematic illustration of a mesh made of two insulated conductors to form an electrostatic precipitator element.

In FIG. 1, a piece of mesh indicated by numeral 10 is made of, for example, two interwoven insulated electric conductors 12 and 14, such that sections of the respective conductors 12, 14 define openings 16 of the mesh 10. The electric conductors 12 and 14 consist of a wire 18 or 20 wrapped by a layer of insulation (not indicated) such that no electric current flows between the two conductors 12, 14 when a steady DC voltage is applied across the wires 18, 20 of the respective conductors 12, 14.

However, an electric field is created in each of the openings 16 of the mesh 10 when the wires 18, 20 of the respective electric conductors 12, 14 are connected to a source of electric voltage, for example, an AC voltage with relatively high voltage magnitude thereof, as illustrated in FIG. 1. The mesh 10 with insulated electric conductors 12, 14 connected to the source of the AC electric voltage, adapted to function as an electrostatic precipitator element, is then disposed in an environment so as to allow an aerosol flow such as an oil/air mixture (not shown) to pass through the openings 16 of the mesh 10. Because of the AC voltage applied to the wires 18, 20 of the respective electric conductors 12, 14, alternating electric fields are created in the openings 16, periodically changing the polarities of the electric fields. If the frequency of the AC voltage is expressed as 1/T, the polarity of the electric fields is reversed every T/2 seconds (or milliseconds, as the case may be). The particles (not shown) suspended in the aerosol flow, for example the oil particles suspended in air, are electrically charged by the displacement current when the oil/air mixture flows through the openings 16 of the mesh 10. The electrically charged oil particles suspended in the air flow arc attracted to one of the electric conductors 12, 14 which has a polarity opposite to the charges of the oil particles. The electrically charged oil particles reach the surface of the insulation of one of the electric conductors 12, 14, and then are accumulated thereon due to the viscosity thereof. When the polarities of the electric field in each of the openings 16 is reversed after the time period T, the newly electrically charged oil particles suspended in a subsequent portion of the oil/air mixture flow are attracted to the other of the electric conductors 12, 14 which now has a polarity opposite to that of the charges of the oil particles. Therefore, the electrically charged oil particles are alternately attracted to the insulated surfaced of the respective electric conductors 12, 14.

In contrast to conventional electrostatic precipitators in which charged particles are neutralized on the conductive surface of an electrode having a polarity opposite to that of the charged particles, the charged oil particles of the present concept cannot be neutralized upon contact with one of the electric conductors 12, 14 because the electric conductors 12, 14 are insulated by the outer layer of insulation (this is a somewhat similar effect to the familiar experience of a charged birthday balloon sticking to another insulated surface, such as a wall). However, an alternating electric field created by the AC voltage, not only periodically converts its polarities but also periodically changes magnitude. In particular, the magnitude of the voltage of the electric field increases from zero to a maximum level and then decreases to zero in the first half of the time period T and then the polarities of the electric field reverse and the magnitude of the voltage thereof also increases from zero to the maximum level and then decreases to zero in the second half of the time period T. Thus, oil particles in the electric field are periodically electrically charged and neutralized. The oil droplets will stay on the surface of the insulation of the respective electric conductors 12, 14 by the oil's viscosity and or surface tension and thus will not be repelled by the electric conductor on which the oil particles are accumulated when that electric conductor reverses its polarity. The oil droplets are accumulated to a point at which the oil droplets drip from the mesh 10 under the force of gravity.

The mesh 10 to be used as an electrostatic precipitator of the present concept, functions similarly to a capacitor which forms a closed circuit in order to allow a displacement current to flow through when connected to a source of AC voltage. In order to improve the performance of the electrostatic precipitator element, it is preferable to choose a highly dielectric insulator material for use as the insulation of the electrical conductors 12, 14. In further consideration of the working environment of the electrostatic precipitator element of the present concept, particularly relating to gas turbine engines, Teflon™ is preferable as the dielectric insulation of the electric conductors 12, 14.

It is not recommended to use a source of AC voltage having a very high frequency such that most of the electrically charged oil particles attracted towards the electric conductors 12, 14, will be repelled by the same one of the electric conductors because of a polarity reversal of that electric conductor before they reach their destination. Therefore, it is preferable that a time interval (travel t) needed for the electrically charged oil particles to travel through the alternating electric field to one of the electric conductors 12, 14 having an instant polarity which attracts the charged oil particles, is less than half the period T of the AC voltage (polarity reversal 0.5 T) needed to complete one reversal of the polarities of the AC voltage. However, the travel t is determined by a plurality of factors such as the magnitude of the AC voltage and the size of an effective space of the electric field. The effective space of the alternating electric field is further determined by the physical geometry, configuration and size of the openings of the mesh. Therefore, the frequency and the magnitude of the AC voltage to be applied to the electrostatic precipitator element of the present concept, is determined depending on the particular configuration of the electrostatic precipitator element.

Although a source of AC voltage is preferred to be connected to the electric conductors 12, 14 of the mesh 10, a source of DC voltage may also be applicable for the mesh 10 used as an electrostatic precipitator element. For example, the wire 18 of electric conductor 12 may be connected to a positive end of a controllable DC voltage source (not shown) and the wire 20 of the electric conductor 14 is grounded or connected to a negative end of the controllable DC voltage source. In order to use the mesh 10 as an electrostatic precipitator element of the present concept, the controllable DC voltage is controlled to change the voltage magnitude periodically between zero and the maximum level in a predetermined frequency such that the electric field created in the respective openings 16 of the mesh 10 periodically changes strength between zero and a maximum level but does not change the polarities thereof. In such an application, the oil particles which are suspended in the oil/air mixture and charged in the electrical field, are attracted to the insulated surface of only one of the electric conductors 12, 14.

Figure 2:
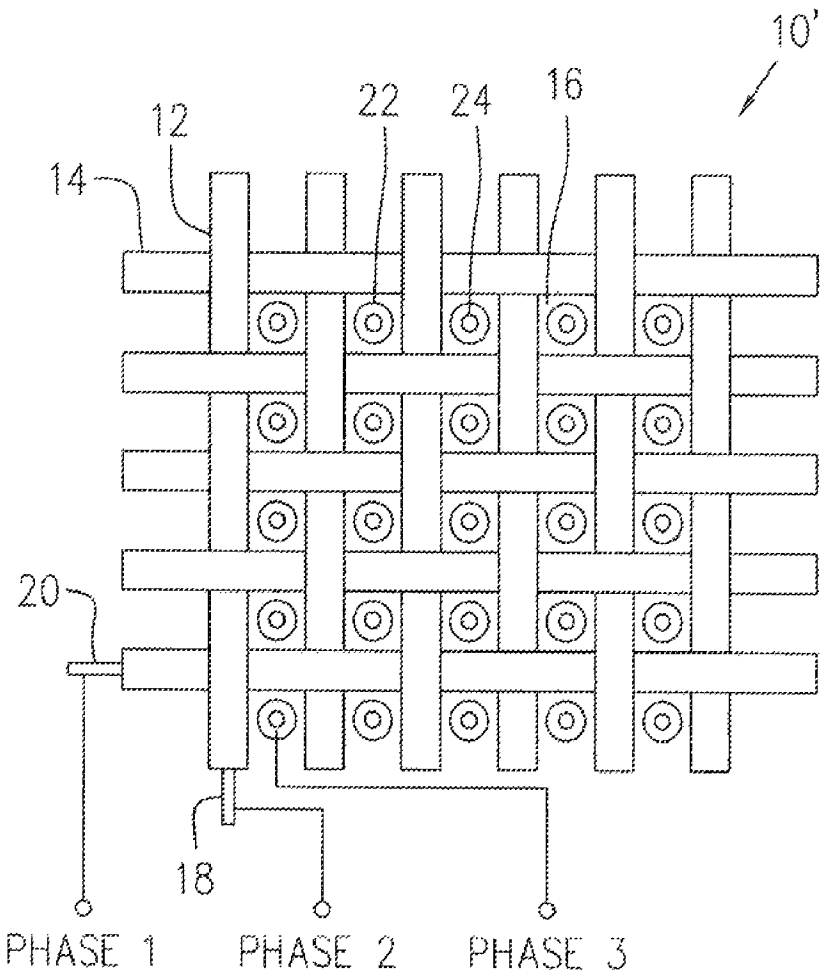
FIG. 2 is a schematic illustration of a mesh made of three insulated conductors to form an electrostatic precipitator element.
Figure 3:
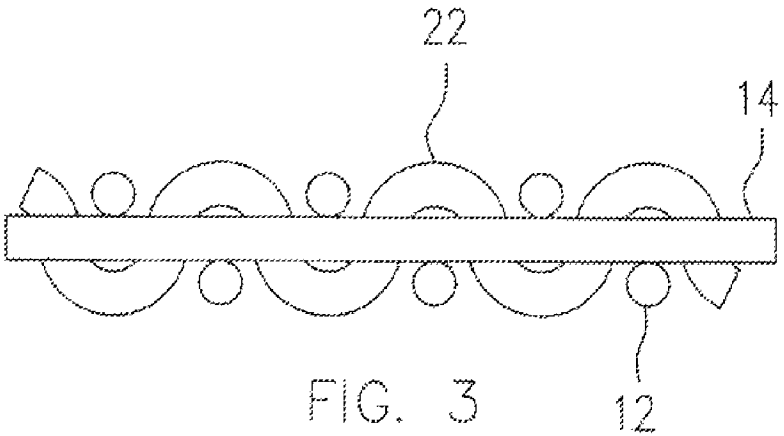
FIG. 3 is a schematic illustration in a side view of the mesh made of three insulated conductors of FIG. 2.

Referring to FIGS. 2 and 3, an electrostatic precipitator element indicated by numeral 10' is described according to another embodiment. The electrostatic precipitator element 10' is a modification of the mesh 10 of FIG. 1 and similarly includes a mesh (not indicated) made of interwoven insulated electric conductors 12, 14 defining a plurality of openings 16 of the mesh. A third insulated electric conductor 22 extends interstitially through the openings 16 of the mesh in a woven or knitted manner as shown in FIG. 3. The insulated conductors 12, 14 and 22 have wires 18, 20 and 24 respectively. The respective wires 18, 20 and 24 are connected to a source of voltage, for example a 3-phase AC voltage, in which the respective phases 1, 2 and 3 of the AC voltage have the same frequency and magnitude but with a time differential (phase difference) relative one to another. In an alternative arrangement of an AC voltage connection (not shown), electric conductors 12, 14 can be connected to a source of AC voltage (one phase) similar to that of FIG. 1 and the electric conductor 22 is always grounded. The added electric conductor 22 will improve the performance of the electrostatic precipitator element 10' by improving the strength distribution of the electric field in each opening 16 of the mesh 10'. The added electric conductor 22 also increases the particle attaching surface area of the electrostatic precipitator element 10', which results in an improvement in precipitation efficiency. It should be noted that the openings 16 defined by the sections of the respective electric conductors 12, 14 are sized large enough to not only allow the electric conductor 22 to extend therethrough but also to leave enough space around the electric conductor 22 to form adequate passages for an aerosol flow such as an oil/air mixture flow to pass through the electrostatic precipitator element 10'.

Figure 4:
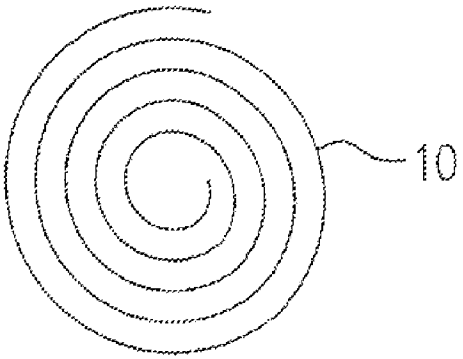
FIG. 4 is a schematic illustration of the mesh of FIG. 1 rolled up to form a spiral shaped electrostatic precipitator element.
Figure 5:
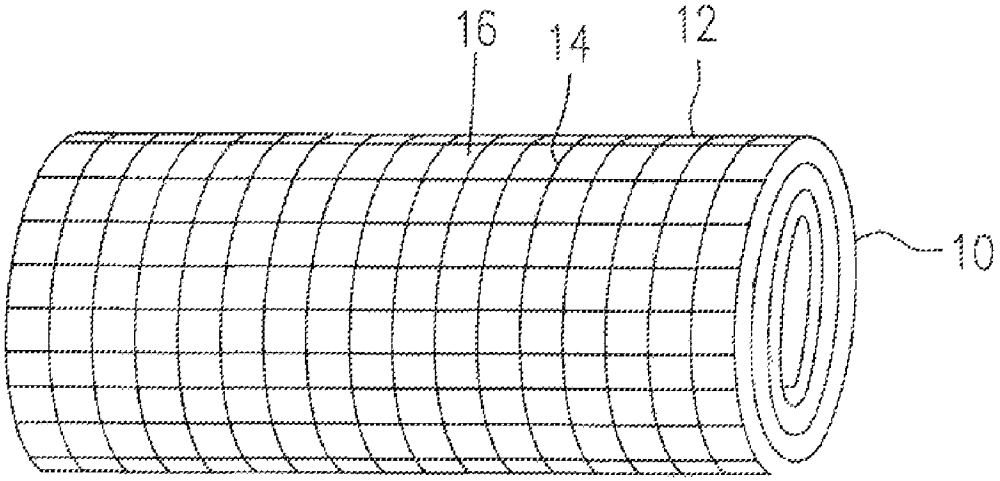
FIG. 5 is a perspective illustration of the spiral-shaped electrostatic precipitator element of FIG. 4.
Figure 6:
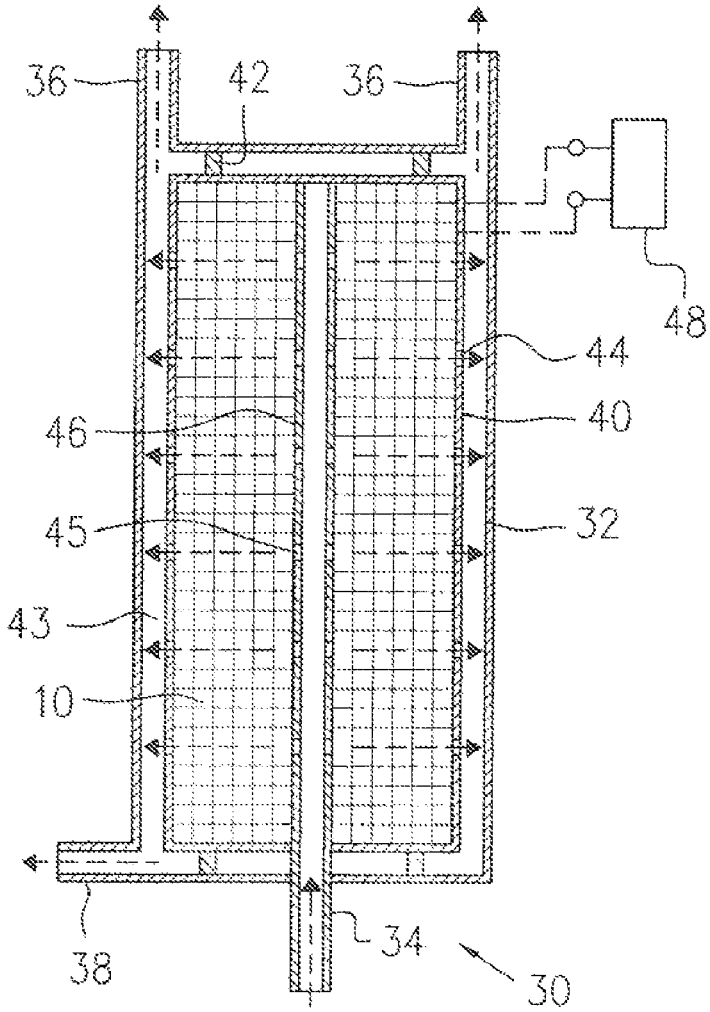
FIG. 6 is a schematic illustration in a cross-sectional view, of an electrostatic precipitator.

Referring to FIGS. 4-6, an electrostatic precipitator generally indicated by numeral 30, is described according to one embodiment of the present concept. The electrostatic precipitator 30 includes a housing or container 32 having an inlet 34, disposed on one end of the container 32, for introducing a flow of an oil/air mixture into the container 32. The container 32 further includes an outlet, preferably a plurality of outlets 36, disposed preferably on the other end of the container 32 spaced apart one from another along the circumference of the container 32, for discharging an air flow, and another outlet 38 preferably disposed at a lower part of the container 32 for discharging liquid oil.

The container 32 is preferably cylindrical for receiving a spiral roll of a mesh 10 of FIG. 1. The mesh 10 of FIG. 1 is formed in a rectangular sheet having a width smaller than the length of the cylindrical container 32, and is rolled along a length of the mesh sheet to form the spiral roll as shown in FIGS. 4 and 5. The spiral roll of mesh 10 is supported within the container 32 and is located between the inlets 34 and the first outlet 36 to permit the air/oil mixture introduced from the inlets 34, to flow therethrough.

Referring now to FIG. 6, in a preferred arrangement, an inner cylindrical casing 40 is provided for supporting the spiral roll of mesh 10 and for directing the oil/air mixture flow within the container 32. The inner cylindrical casing 40 has a diameter smaller than that of the container 32 and is affixed to the container 32 by for example, support elements 42 such that the cylindrical wall of the inner casing 40 is radially spaced apart from the cylindrical wall of the container 32 to form an annular passage 43 therebetween which is in communication with the outlets 36. Casing 40 houses electrostatic spiral roll of mesh 10. An inlet tube 46 is preferably disposed in the center of the spiral roll of mesh 10, supported, for example by the inner casing 40 and preferably extending axially all the way through the spiral roll of mesh 10. The tube 46 is in communication with or is integrated with the inlet 34, and has a plurality of preferably holes 45 extending therethrough so as to allow air-oil flow within the tube 46 to be directed and discharged through the tube 46 into mesh 10. Similarly to the inlet tune 46, a plurality of holes 44 are preferably defined through the cylindrical wall of the inner casing 40 and are preferably distributed over the entire area of the cylindrical wall of the inner casing 40. The inner casing 40 may be used to assist directing the oil/air mixture flow into the container 32 from the mesh 10, and to flow axially along the annular passage 43 to outlets 36. A generally radial outward flow is desired because the velocity of the air-oil mixture flow will tend to reduce as it moves from the inner diameter to the outer diameter, which assists the separation effect. The lower the velocity of the air near the exit, the lower the aerodynamic forces will be on the oil causing oil to exit with the air (undesired). Positioning the device as shown in FIG. 6, such that the oil outlet 38 and mixture inlet 34 are both lower than the air outlet(s) 36 also allows gravity to assist the separation process.

A source of AC voltage 48, for example, is also provided and the electric conductors 12, 14 of the spiral roll of mesh 10 are connected to the source of the AC voltage 48. When the oil/air mixture flow is directed through the spiral roll of mesh 10, oil particles suspended therein will be charged by the alternating electric field created in the vicinity of the electric conductors 12, 14, particularly in the individual openings 16 of the spiral roll of mesh 10 and will be attracted to the insulated surfaces of the electric conductors 12, 14. The remaining portion of the flow which is a relatively pure air flow, enters the annular passage 43 and is discharged from the outlets 36 to the atmosphere, or to a predetermined location, if desired. The oil particles attracted to the surfaces of the insulated electric conductors 12, 14 are eventually accumulated to form larger oil droplets. These large oil droplets under gravity drip to a lower portion of the cylindrical wall of the container 32 and are collected as liquid oil to drain out of the container 32 through the outlet 38.

Figure 7:
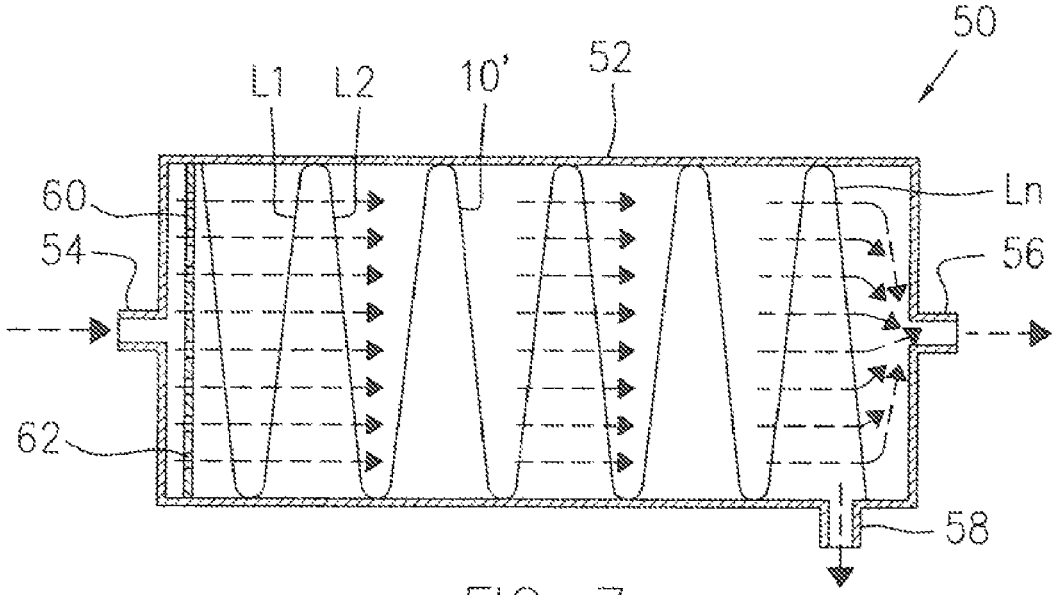
FIG. 7 is a schematic illustration in a side cross-sectional view, of another electrostatic precipitator.

FIG. 7 illustrates an electrostatic precipitator 50 according to another embodiment. The electrostatic precipitator 50 includes a container 52 having an inlet 54 defined in one end thereof for introducing an oil/air mixture flow therein. The container 52 further includes a first outlet 56 on the other end thereof for discharging an air flow separated from the oil/air mixture flow entering the container 52, and a second outlet 58 defined in a lower portion of the container 52 for discharging liquid oil separated from the oil/air mixture flow entering the container 52. The container 52 is preferably in a rectangular prism configuration having substantially parallel side walls (not shown) and top and bottom walls (not indicated) to define a prismatic space for accommodating an electrostatic precipitator element 10' of FIG. 2, which is multi-folded to form a plurality of layers L1, L2, . . . Ln. The three insulated electric conductors 12, 14, 22 of the electrostatic precipitator element 10' (see FIG. 2) are connected to a source of 3-phase AC voltage to create the desired electric fields within the container 52 such that when the oil/air mixture flow entering the container 52 through the inlet 54 passes through the plurality of layers L1, L2, . . . Ln of the electrostatic precipitator element 10', the oil particles suspended in the flow are electrically charged by the electric fields and are attracted to the electrostatic precipitator element 10' to form larger oil droplets thereon. Under force of gravity, the larger oil droplets drip onto the bottom wall of the container 52 and accumulate to form liquid oil which is directed to the second outlet 58 and drained out through the second outlet 58. The remaining portion of the oil/air mixture flow which is a relatively pure air flow, is discharged through the first outlet 56.

It is preferable to position a partition plate 60 within the container 52 at the end where the inlet 54 is defined. The partition plate 60 is spaced apart from that end wall (not indicated) of the container 52 and has a plurality of holes 62 therethrough. The partition plate 60 is used to redistribute the oil/air mixture flow entering the container 52 through the inlet 54, to the entire cross-section of the container 52, before passing through the multiple layers of the electrostatic precipitator element 10' in order to improve the performance of the electrostatic precipitator element 10'.

The electrostatic precipitator 50 may be positioned either in a vertical position or a horizontal position which is shown in FIG. 7 as a choice of description only. If the electrostatic precipitator 50 is in a vertical position, the outlet 58 and inlet 54 both are located in a lower end of the container 52 while the outlet 56 is located in an upper end of the container 52.

The electrostatic precipitator of the present concept uses woven insulated conductors such that significantly lower voltages are applied to the insulated electrodes in close proximity, in contrast to very high voltages applied to electrodes without insulation layers in conventional electrostatic precipitators, and can result in equal or higher strengths of electric fields. In addition, the insulated layers of the electrodes substantially eliminate the risk of arcing which may be problematic in some applications of conventional electrostatic precipitators where the fluids or gas-particle mixture may be ignited by a spark.

This present concept permits oil/air separation in a gas turbine engine where a compact and arc-free system is preferable.

The above description is meant to be exemplary only and one skilled in the art will recognize that changes may be made to the embodiments described without departure from the scope of the concept disclosed. For example, alternative to a mesh woven by insulated conductors, the electrostatic precipitator element may be otherwise made of two or more insulated conductors in a preferably close relationship of any configuration (i.e. not necessarily an organized mesh) to define air passages therebetween and to create a preferably substantially continuous region of electric field having sufficient strength to achieve the separation function described herein in the vicinity of the insulated conductors. Furthermore, the electrostatic precipitator element may be configured in any desirable form, such as to increase the surface areas of the insulated surfaces of the respective conductors in order to attract the electrically charged oil particles. The electrostatic precipitator can also be positioned in any orientation and not just those described. Although the electrostatic precipitator is described in an application of separating oil from an oil/air mixture flow, it should be understood that the system is applicable in general for separation of suitable liquids or solid particles from gases. Still other modifications which fall within the scope of the present invention will be apparent to those skilled in the art, in light of a review of this disclosure and such modifications are intended to fall within the appended claims.

The invention claimed is:

1. An electrostatic precipitator element comprising:

a mesh made of first, second and third insulated conductors, the first and second insulated conductors arranged relative to one another to define openings of the mesh, the third insulated conductor extending through the individual openings of the mesh, the first, second and third conductors being configured to be connected to a voltage source to thereby in use create an electric field among the first, second and third conductors; and an apparatus configured for directing an aerosol flow through the openings of the mesh, wherein, in use, particulate matters suspended in the aerosol flow are electrostatically attracted to at least one of the first, second and third conductors when said electric field is present.

2. The electrostatic precipitator element as claimed in claim 1 wherein the first and second conductors are interwoven such that sections of the first conductor are substantially perpendicular to sections of the second conductor.

3. The electrostatic precipitator element as claimed in claim 1 wherein the first, second and third conductors are configured to be connected to respective phases of a 3-phase AC voltage source.

4. The electrostatic precipitator element as claimed in claim 1 wherein the respective first, second and third conductors comprise an outer insulation layer of Teflon™.

5. An electrostatic precipitator comprising:

a container including an inlet for introducing a flow of an oil/air mixture thereinto, and a first outlet for discharging an air flow and a second outlet for discharging liquid oil; and a mesh supported within the container and located between the inlet and the first outlet, the mesh being formed with at least three conductors to define openings of the mesh to permit the oil/air mixture to flow therethrough, the three conductors being individually insulated and adapted to receive an electric voltage applied thereover to create an electric field in each of the openings, thereby attracting oil particles in the oil/air mixture to an insulated surface of at least one of the three conductors to form oil droplets to be discharged through the second outlet.

6. The electrostatic precipitator as claimed in claim 5 comprising a 3-phase AC voltage source connected to the respective conductors of the mesh to create an alternating electric field within each of the openings of the mesh.

7. The electrostatic precipitator as claimed in claim 5 wherein the mesh is multi-folded to form a plurality of layers thereof.

8. The electrostatic precipitator as claimed in claim 7 wherein the container defines a chamber for accommodating the multi-folded mesh therein, the inlet and the first outlet of the container being located so as to flow the oil/air mixture through the chamber and thus through the plurality of layers of the mesh, and the second outlet of the container being located at a low position of the container to drain oil collected in the container.

* * * * *